US011141014B2

(12) United States Patent
James

(10) Patent No.: US 11,141,014 B2
(45) Date of Patent: Oct. 12, 2021

(54) MAILBOX WITH AN EXTENDED DOWNWARD SLOPING CHUTE

(71) Applicant: Robert James, Brooklyn, NY (US)

(72) Inventor: Robert James, Brooklyn, NY (US)

( * ) Notice: Subject to any disclaimer, the term of this patent is extended or adjusted under 35 U.S.C. 154(b) by 13 days.

(21) Appl. No.: 16/683,548

(22) Filed: Nov. 14, 2019

(65) Prior Publication Data

US 2021/0145199 A1 May 20, 2021

(51) Int. Cl.
*A47G 29/12* (2006.01)
*A47G 29/124* (2006.01)
*A47G 29/16* (2006.01)

(52) U.S. Cl.
CPC ..... *A47G 29/12095* (2017.08); *A47G 29/124* (2013.01); *A47G 29/16* (2013.01); *A47G 2029/1257* (2017.08)

(58) Field of Classification Search
CPC ..... A47G 29/12095; A47G 29/124; A47G 29/16; A47G 2029/1257; B65G 2201/0285
USPC ..... 232/17, 45–52; 193/8
See application file for complete search history.

(56) References Cited

U.S. PATENT DOCUMENTS 3,874,583 A * 4/1975 Moll ..... A47G 29/12095 232/17
5,833,132 A * 11/1998 Bachmeier ..... A47G 29/12095 232/47
6,234,388 B1 * 5/2001 Taylor ..... A47G 29/12095 232/47
6,244,505 B1 * 6/2001 Grimes ..... A47G 29/1216 232/47
6,533,167 B2 * 3/2003 Hassan ..... A47G 29/1216 232/17
2003/0222133 A1 * 12/2003 Esakov ..... A47G 29/1207 232/45
2005/0247771 A1 * 11/2005 Engel ..... A47G 29/12095 232/27

* cited by examiner

*Primary Examiner* — William L Miller
(74) *Attorney, Agent, or Firm* — Ladas & Parry LLP

(57) ABSTRACT

The present invention relates to a mailbox. The mailbox includes an extended downward sloping chute into and through which mail and packages destined for the mailbox's owner can be deposited. The length and orientation of the downward sloping chute makes it difficult if not impossible for the mailbox contents to be accessed and removed through the downward sloping chute. A locked door in the main portion of the box is provided to allow controlled and authorized access to the box's contents.

6 Claims, 3 Drawing Sheets

MAILBOX WITH AN EXTENDED DOWNWARD SLOPING CHUTE

BACKGROUND OF THE INVENTION

Field of the Invention

The present invention generally relates to a mailbox, and more particularly to a mailbox including an extended downward sloping chute into and through which mail and packages destined for the mailbox's owner can be deposited.

Related Art

The conventional mailbox comprises a horizontally elongated body having a small door placed pivotably at the top of the box for placing mail and a locked door at the bottom for removing the mail placed in the box. While such mailboxes may be suitable for mail or small packages, these boxes pose certain disadvantages.

One of the disadvantages commonly associated with the conventional mailbox is that large packages cannot be inserted in the mailbox through the small door at the top of the box. Large packages are therefore often placed next to the mailbox without any means for prevention of pilferage.

There have been attempts to solve the aforementioned problem. For example, U.S. Pat. No. 6,533,167 B2 to Hassan discloses a theft-preventative mailbox for holding various sizes of both mail correspondence and larger sized and mailable parcels. The Hassan mailbox comprises a mail parcel access door on top of the mailbox to permit the insertion of larger sized parcels within the mailbox interior. However, anyone can open the mail parcel access door to see what is in the mailbox and can readily access and steal the items within the mailbox through the top door. Therefore, there is still a need for an improved mailbox to solve the abovementioned pilferage and other problems.

It is with respect to these and other general considerations that embodiments have been described. Also, although relatively specific problems have been discussed, it should be understood that the embodiments should not be limited to solving the specific problems identified in the background.

SUMMARY OF THE INVENTION

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

In one aspect, there is provided a mailbox comprising a body and a downward sloping chute. Preferably, the body comprises a plurality of vertical members and a plurality of horizontal members, wherein the plurality of vertical members and the plurality of horizontal members of the body are configured and arranged to have a hollow inner space in which packages can be deposited. In this embodiment, the downward sloping chute is connected to a top portion of the body of the mail box and comprises a top member, a bottom member, and a plurality of side members. The top, bottom, and plurality of side members of the downward sloping chute can be configured and arranged to form (1) an external opening that is in front of and distanced from the body of the mailbox, and (2) an internal opening that is disposed at a connecting section where the body of the mailbox and the downward sloping chute are connected. The downward sloping chute extends from the second opening to the first opening and is sloped downward with the second opening being disposed higher than the first opening such that the packages can be deposited in the mailbox by sliding the packages up through the first opening toward the second opening.

In another embodiment, the mailbox further comprises a plurality of legs that support the body of the mailbox.

In another embodiment, the body is in a shape of a cuboid.

In an alternative embodiment, the first opening and the second opening are in a shape of a rectangle.

In still another embodiment, one of the vertical members comprises a door pivotably hinged on said one of the vertical members, wherein the door is capable of being locked or unlocked, and wherein a user can access to the packages deposited in the mailbox through the door.

In some embodiments, a height of the mailbox may range from 60 inches to 64 inches, wherein a size of the first opening ranges from 20 inches (width)×8 inches (height) to 24 inches×11 inches, and wherein a size of the hollow inner space of the body ranges from 20 inches (width)×22 inches (length)×18 inches (height) to 24 inches (width)×26 inches (length)×22 inches (height).

In another aspect, there is provided a method of using a mailbox, comprising: (a) providing the mailbox; (b) placing an item in the first opening; (c) sliding up the item through the downward sloping chute until the item is past the second opening and is deposited in the hollow inner space of the body; (d) unlocking the door on said one of the vertical members of the body; (e) removing the item deposited in the hollow inner space of the body; and (f) locking the door after removing the item.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION OF THE INVENTION

The various aspects of the subject innovation are now described with reference to the annexed drawings, wherein like numerals refer to like or corresponding elements throughout. It should be understood, however, that the drawings and detailed description relating thereto are not intended to limit the claimed subject matter to the particular form disclosed. Rather, the intention is to cover all modifications, equivalents, and alternatives falling within the spirit and scope of the claimed subject matter.

Figure 1:
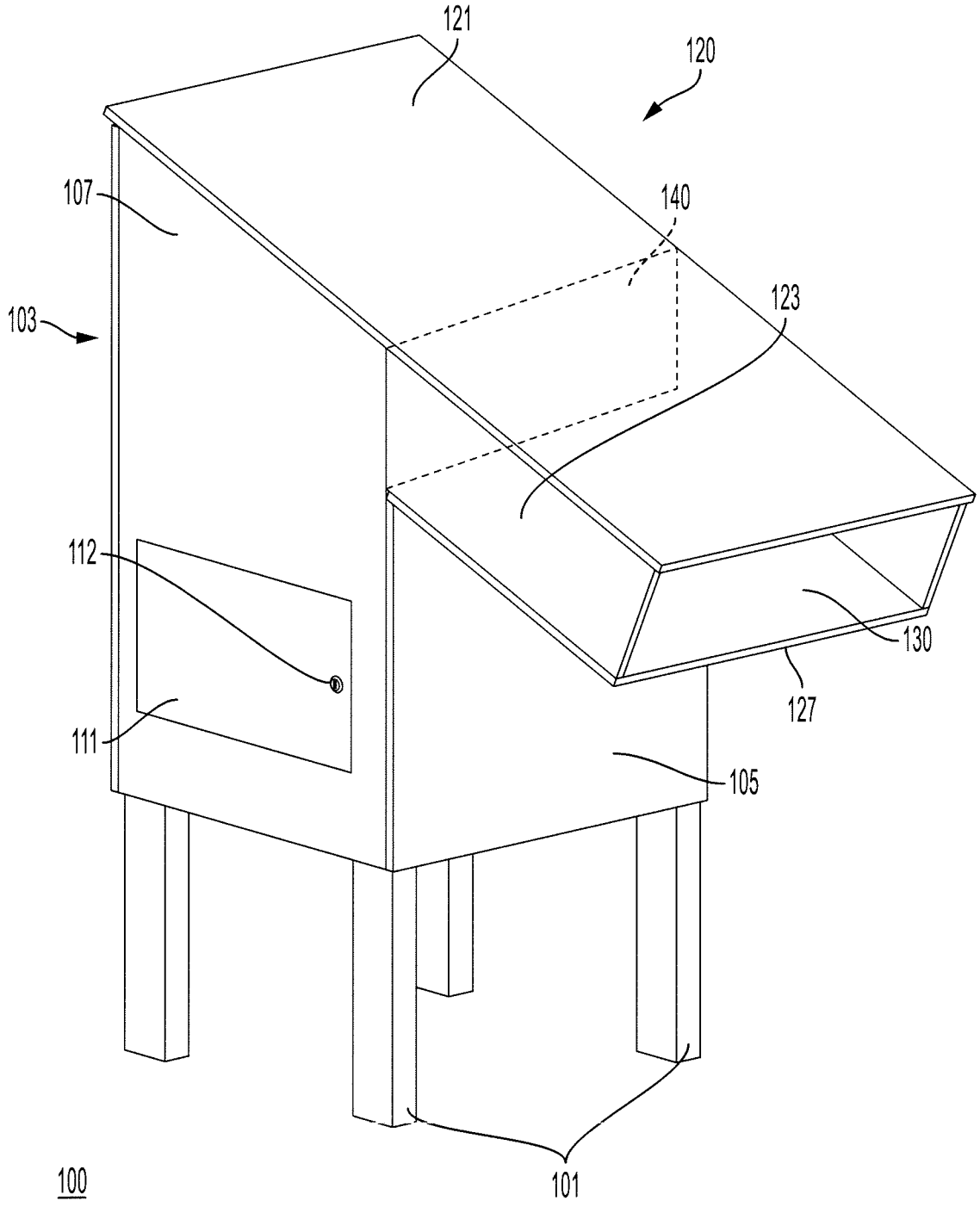
FIG. 1 is a perspective view of an exemplary mailbox according to one embodiment of the present disclosure.
Figure 2:
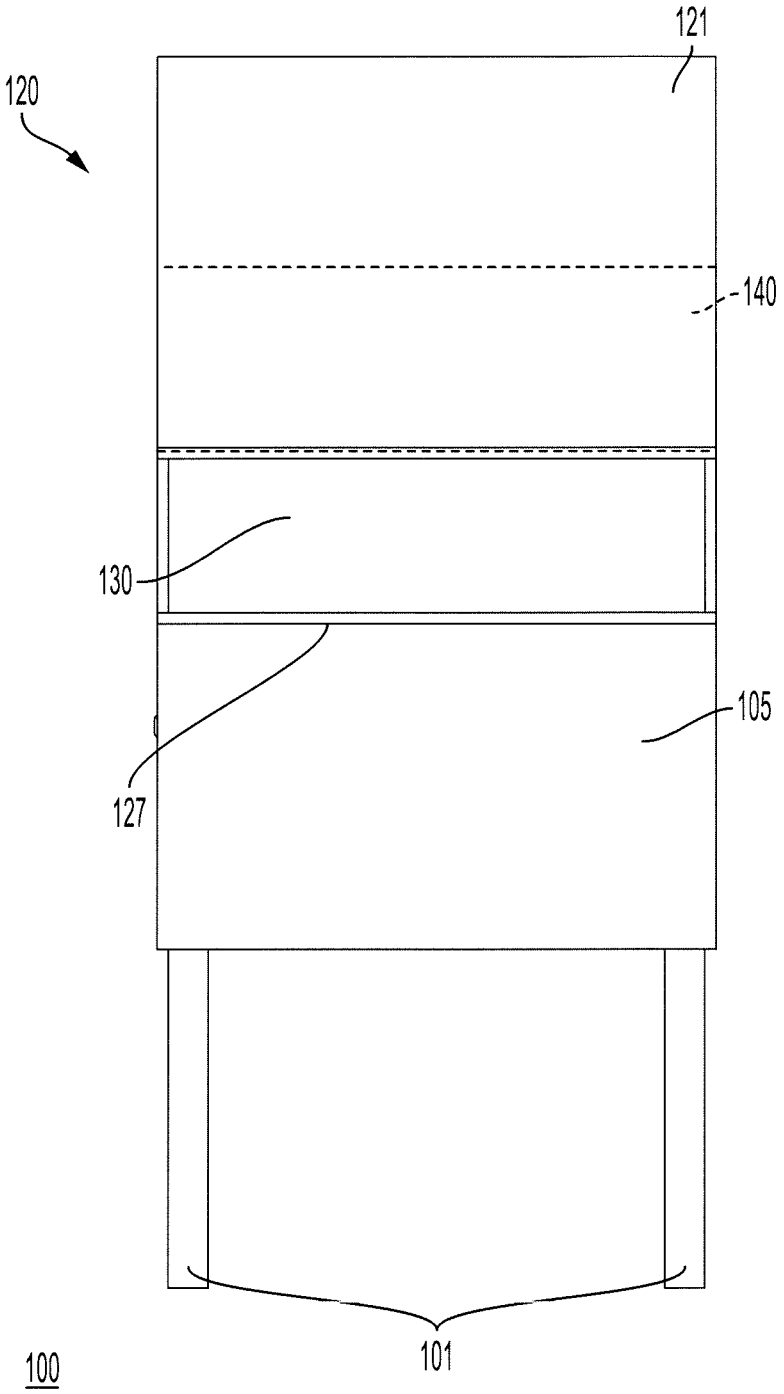
FIG. 2 is a front view of an exemplary mailbox according to one embodiment of the present disclosure.

Referring to FIGS. 1-2, there is seen an exemplary mailbox 100 according to one embodiment of the present disclosure. The mailbox 100 can comprise a plurality of legs 101 and a body 103. The plurality of legs 101 supports the body 103 of the mailbox 100. The body 103 can be in any shape having an inner hollow space. Preferably, the body

103 comprises a front member 105, a rear member (not shown), a right side member 107, a left side member (not shown), and a bottom member (not shown). In a preferred embodiment, the right side member 107 can comprise a door 111 that is pivotably hinged on the right side member 107 of the body 103. The door 111 comprises a lock 112 such that the door 111 allows controlled and authorized access to the mailbox's contents. It is noted that the door 111 can be disposed at any member of the body 103.

Still referring to FIGS. 1-2, the mailbox 100 further comprises a downward sloping chute 120. While the downward sloping chute 120 can be in any appropriate shape to accommodate mail and package of various sizes, in a preferred embodiment, the downward sloping chute 120 comprises a top member 121, a right side member 123, a left side member 125, and a bottom member 127, which together form an external opening 130 that is disposed in front of and distanced from the mailbox 100. The external opening 130 can be distanced from the mailbox 100 at an arm's length or longer such that one cannot easily access items disposed in the mailbox 100. In a preferred embodiment, the top member 121 of the downward sloping chute 120 can extend at a downward slope from the top portion of the rear member of the mailbox 100 to the external opening 130, providing rapid run off of rain. In another embodiment, the top member 121 can extend from the top portion of the rear member of the mailbox 100 to the front member 105 of the mailbox 100 at a first slope or flat, and from the front member 105 of the mailbox 100 to the external opening 130 at a second slope. The rear member is taller than the front member 105 such that the top member 121 of the downward sloping chute 120 is sloped downward towards the external opening 130. The top member 121 is attached to the top portion of the body 103 of the mailbox 100 and to the right side and left side members 125, 127 of the downward sloping chute 120. The right and left side members 125, 127 of the downward sloping chute 120 extends from the front member 105 of the body 103 to the external opening 130 of the downward sloping chute 120 and are attached to the bottom member 127 of the downward sloping chute 120, which also extends from the front member 105 of the body 103 to the external opening 130 of the downward sloping chute 120. In a preferred embodiment, the bottom member 127 is disposed parallel to the top member 121. A connecting section 140 inside the downward sloping chute 120, where the front member 105 of the body 103 meets downward sloping chute 120, forms an internal opening 140 though which items can be deposited in the body 103 of the mailbox 100.

Figure 3:
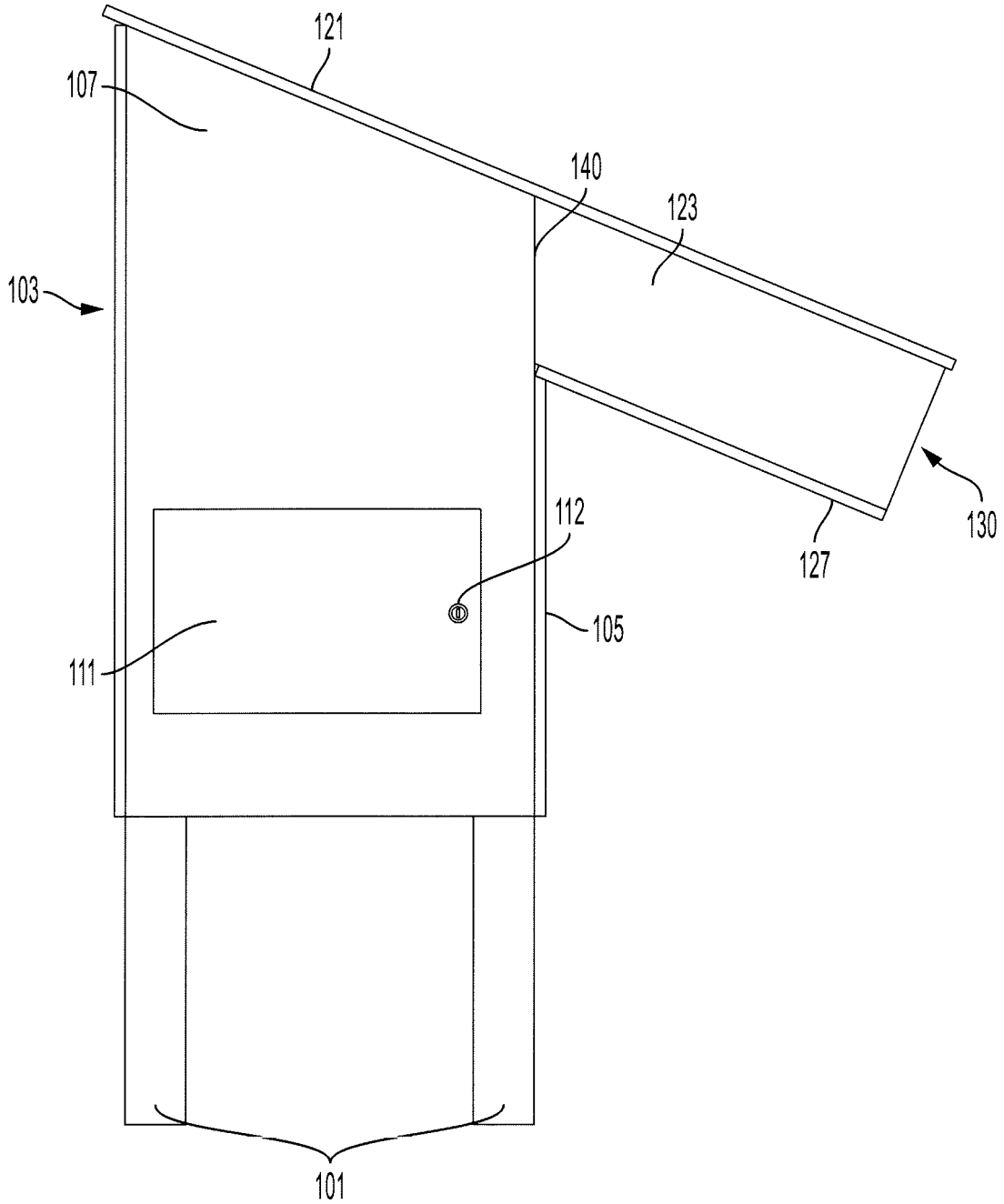
FIG. 3 is a side view of an exemplary mailbox with a door according to one embodiment of the present disclosure.

Referring to FIG. 3, the door 111 of the mailbox 100 is hinged on the right side member 107 and can be opened so that items deposited in the mailbox 100 can be removed by the owner of the mailbox 100. In some embodiments, there can be other types of doors attached to disposed on the front member 105, the left side member, the rear member, and/or the bottom member of the body 103.

The mailbox 100 can be utilized as follows. First, a user places an item in the external opening 130 of the downward sloping chute 120. The user then slides the item up/towards the connecting section 140 (i.e., the inner opening 140). The item is deposited in the hollow space of the body 103 of the mailbox 100 upon passing the connecting section 140. Later, an owner of the mailbox 100 can unlock the lock 112 on the door 111 on the right side member 107 and remove items deposited in the body 103 of the mailbox 100.

Preferably, an overall height of the mailbox can range from 55 inches to 70 inches. The external opening 130 of the downward sloping chute 120 can range from 15 inches (width) by 7 inches (height) to 25 inches (width) by 13 inches (height). The body 103 of the mailbox 100 can range from 14 inches (width)×18 inches (length)×14 inches (height) to 30 inches (width)×32 inches (length)×18 inches (height).

In another embodiment, the length of the bottom member 127 can range from 20" to 28". The external opening 130 of the downward sloping chute 120 can range from 8" (length)×20" (width) to 12" (length)×25" (width). The body 103 of the mailbox 100 can range from 18" (height)×20" (width)×22" (length) to 24" (height)×26" (width)×28" (length). The overall height of the mailbox 100 can range from 55" to 70". The length of the top member 121 can range from 44" to 50".

Each member of the mailbox 100 can be made of wood, metal, plastic, vinyl, or any other material conventionally known. The body 103 of the mailbox 100 and the downward sloping chute can be a shape of a cylinder, cube, cuboid, polygonal prism, etc.

The mailbox 100 has a number of advantages over the prior art. The external opening 130 of the downward sloping chute and the internal opening 140 of the connecting section are substantially large enough to allow a user to deposit bulky items in the mailbox 100. Additionally, items in the mailbox 100 cannot be viewed or reached from the outside because of the structure of the downward sloping chute 120, making stealing of the deposited items difficult.

What has been described above includes various exemplary aspects. It is, of course, not possible to describe every conceivable combination of components or methodologies for purposes of describing these aspects, but one of ordinary skill in the art may recognize that many further combinations and permutations are possible. Accordingly, the aspects described herein are intended to embrace all such alterations, modifications, and variations that fall within the spirit and scope of the appended claims.

What is claimed is:

1. A mailbox, comprising:

a body; and a downward sloping chute;

wherein the body comprises a plurality of vertical members and a plurality of horizontal members, wherein the plurality of vertical members are vertical with respect to a ground and the plurality of horizontal members are parallel to the ground, wherein the plurality of vertical members and the plurality of horizontal members of the body are configured and arranged to form a hollow inner space in which packages can be deposited, wherein the downward sloping chute is connected to a top portion of the body of the mail box and comprises a top member, a bottom member adapted for the placement of mail inserted into the mailbox directly thereon, and a plurality of side members, each of the top, bottom and side members being in a fixed, non-movable orientation, wherein the top, bottom, and plurality of side members of the downward sloping chute are configured and arranged to form:

an external first opening that is in front of and distanced from the body of the mailbox, and an internal second opening that is disposed at a connecting section where the body of the mailbox and the downward sloping chute are connected, and wherein the downward sloping chute extends from the second opening to the first opening and is sloped downward with the second opening being disposed higher than the first opening such that the packages can be deposited in the mailbox by sliding the packages through the first opening toward the second opening upon the fixed bottom member whereby the packages travel upwardly along the fixed bottom member until the packages reach a point whereby the packages extend beyond the second opening to a degree that the packages can drop off the fixed bottom member under the influence of gravity.

2. The mailbox of claim 1, further comprising a plurality of legs that support the body of the mailbox.

3. The mailbox of claim 1, wherein the body is in a shape of a cuboid.

4. The mailbox of claim 3, wherein the first opening and the second opening are in a shape of a rectangle.

5. The mailbox of claim 1, wherein one of the vertical members comprises a door pivotably hinged on said one of the vertical members, wherein the door is capable of being locked or unlocked, and wherein a user can access to the packages deposited in the mailbox through the door.

6. The mailbox of claim 1, wherein a height of the mailbox ranges from 60 inches to 64 inches, wherein a size of the first opening ranges from 20 inches (width)×8 inches (height) to 24 inches (width)×11 inches (height), and wherein a size of the hollow inner space of the body ranges from 20 inches (width)×22 inches (length)×18 inches (height) to 24 inches (width)×26 inches (length)×22 inches (height).

* * * * *